US011760589B2

(12) United States Patent
Tsuda

(10) Patent No.: US 11,760,589 B2
(45) Date of Patent: Sep. 19, 2023

(54) SHEET FEEDING DEVICE AND IMAGE FORMING APPARATUS

(71) Applicant: CANON KABUSHIKI KAISHA, Tokyo (JP)

(72) Inventor: Satoshi Tsuda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/501,747

(22) Filed: Oct. 14, 2021

(65) Prior Publication Data

US 2022/0033204 A1 Feb. 3, 2022

Related U.S. Application Data

(63) Continuation of application No. 16/917,546, filed on Jun. 30, 2020, now Pat. No. 11,174,112.

(30) Foreign Application Priority Data

Jul. 10, 2019 (JP) ..... 2019-128407

(51) Int. Cl.
*B65H 3/06* (2006.01)

(52) U.S. Cl.
CPC ..... *B65H 3/0676* (2013.01); *B65H 3/0661* (2013.01)

(58) Field of Classification Search
CPC ..... B65H 3/0676; B65H 3/0661
See application file for complete search history.

(56) References Cited

U.S. PATENT DOCUMENTS

2018/0120726 A1* 5/2018 Aono ..... B65H 3/0638
2019/0077621 A1* 3/2019 Kato ..... B65H 3/5261

* cited by examiner

*Primary Examiner* — Thomas A Morrison
(74) *Attorney, Agent, or Firm* — Canon U.S.A., Inc. I.P. Division

(57) ABSTRACT

A sheet feeding device includes a stacking member, a feeding unit, and a detachable separation unit. The feeding unit feeds sheets stacked from the stacking member. The separation unit separates the fed sheets one by one. The separation unit includes a rotating member to abut and separate from the feeding unit and to rotate, a biasing member to bias the rotating member toward the feeding unit, and an engaged member to be engaged with an engagement member included in the sheet feeding device. The engagement member can move to a first position where the engagement member is engaged with the engaged member, and a second position away from the engaged member. Where the engagement member moves from the first to the second position when the separation unit is attached to the sheet feeding device, the separation unit moves in a detachment direction using the biasing member.

8 Claims, 10 Drawing Sheets

SHEET FEEDING DEVICE AND IMAGE FORMING APPARATUS

CROSS-REFERENCE TO RELATED APPLICATIONS

The present application is a continuation of U.S. patent application Ser. No. 16/917,546, filed on Jun. 30, 2020, which claims priority from Japanese Patent Application No. 2019-128407 filed Jul. 10, 2019, which are hereby incorporated by reference herein in their entireties.

BACKGROUND

Field of the Invention

The present disclosure relates to a sheet feeding device including a separation unit, and an image forming apparatus.

Description of the Related Art

An image forming apparatus such as a copying machine and a printer includes a sheet feeding device that conveys a sheet from a storage unit. The sheet feeding device includes a separation unit that conveys sheets one by one while preventing the conveyance of a plurality of stacked sheets (double-feed).

As the separation unit, there is a separation unit using a method of forming a nip between a feed roller and a separation roller formed of rubber with a high friction coefficient, and taking out sheets one by one. The separation roller is of a plate-like pad type or a roller type in which a torque limiter is included within the roller. In either case, the separation roller is biased toward the feed roller with a predetermined pressure.

If abrasion occurs in the separation unit due to friction with a plurality of sheets, the separation performance of the separation unit may decrease. Thus, Japanese Patent Application Laid-Open No. 2016-204150 discusses a configuration in which a separation unit is replaced.

SUMMARY

According to an aspect of the present disclosure, a sheet feeding device configured to feed a sheet includes a storage unit including a stacking member and configured to store sheets stacked in the stacking member, a feeding unit configured to feed the sheets stacked in the stacking member, and a separation unit detachable from the sheet feeding device and configured to separate the sheets fed by the feeding unit one by one, wherein the separation unit includes a separation rotating member configured to abut and separate from the feeding unit and rotate, a biasing member configured to bias the separation rotating member toward the feeding unit, and an engaged member configured to be engaged with an engagement member included in the sheet feeding device, wherein the engagement member is configured to move to a first position where the engagement member is engaged with the engaged member, and a second position away from the engaged member, and wherein, in a case where the engagement member moves from the first position to the second position in a state where the separation unit is attached to the sheet feeding device, the separation unit moves in a detachment direction using the biasing member.

Further features of the present disclosure will become apparent from the following description of exemplary embodiments with reference to the attached drawings.

DESCRIPTION OF THE EMBODIMENTS

Exemplary embodiments for implementing the present disclosure will be described below with reference to the drawings.

Figure 1:
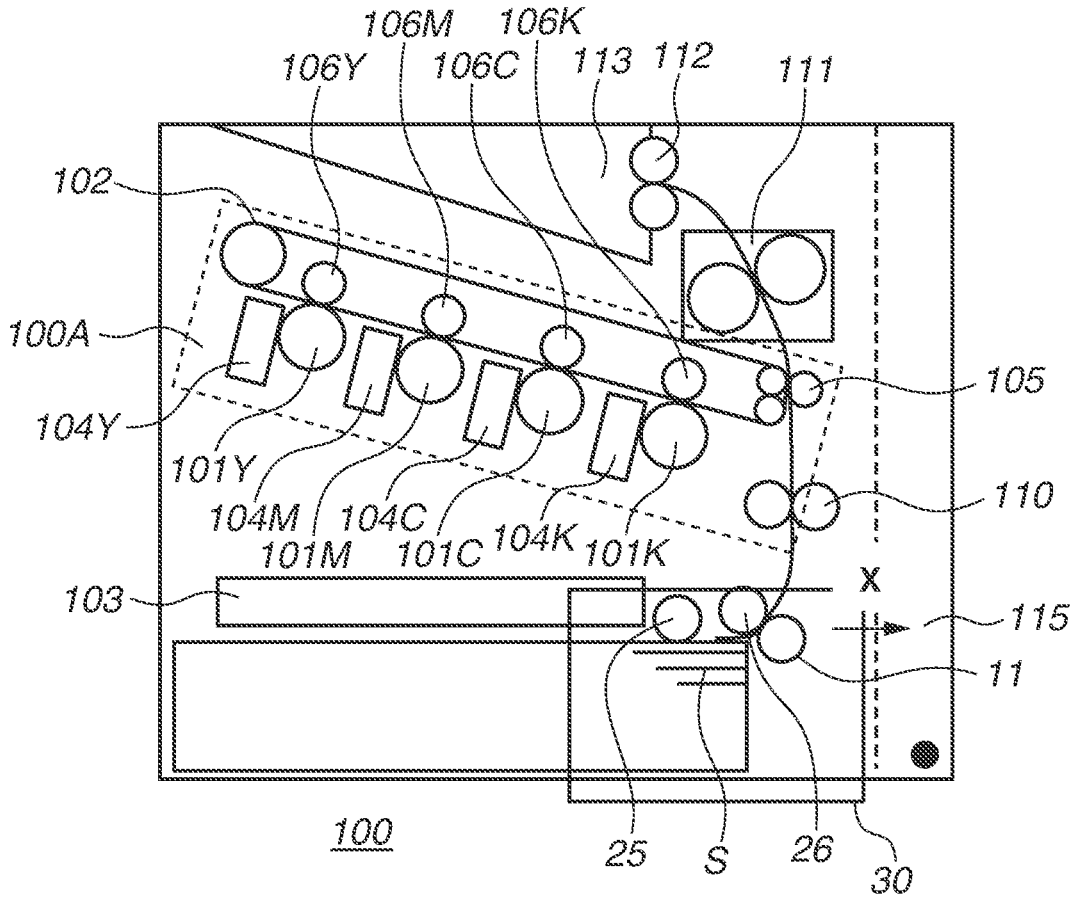
FIG. 1 is a schematic diagram illustrating a sheet feeding device and an image forming apparatus.

FIG. 1 is a schematic diagram illustrating a sheet feeding device and an image forming apparatus according to a first exemplary embodiment. A description is given based on the drawings, taking an electrophotographic color laser printer (hereinafter, referred to as a printer 100) as an example of the image forming apparatus. Although the printer 100 employs an electrophotographic method in this case, the present disclosure is not limited thereto, and is also applicable to an inkjet method. In the present exemplary embodiment, a part of the printer 100 forms a sheet feeding device 30 that feeds a sheet. Alternatively, another configuration may be used. For example, a feeding deck connected as an option device to the printer 100 may be the sheet feeding device 30.

As illustrated in FIG. 1, the printer 100 includes an image forming unit 100A and the sheet feeding device 30. The image forming unit 100A includes four photosensitive drums 101Y, 101M, 101C, and 101K that form toner images of four colors, i.e., yellow, magenta, cyan, and black, respectively. Further, the image forming unit 100A includes an endless intermediate transfer belt 102 which comes into contact with the four photosensitive drums 101Y, 101M, 101C, and 101K and onto which the toner images formed on the four photosensitive drums 101Y, 101M, 101C, and 101K are primarily transferred. Further, the image forming unit 100A includes primary transfer rollers 106Y, 106M, 106C, and 106K that press the photosensitive drums 101Y, 101M, 101C, and 101K, respectively, via the intermediate transfer belt 102 from the inner circumferential side thereof. Transfer voltages are applied to the primary transfer rollers 106Y, 106M, 106C, and 106K from a transfer power supply (not illustrated), thereby generating potential differences between the photosensitive drums 101Y, 101M, 101C, and 101K and the intermediate transfer belt 102. With these potential differences, the toner images are primarily transferred from the photosensitive drums 101Y, 101M, 101C, and 101K onto the intermediate transfer belt 102. Further, the image forming unit 100A includes a secondary transfer roller 105 that secondarily transfers onto a sheet S the image transferred on the intermediate transfer belt 102.

If an image forming operation is started by the image forming unit 100A, a laser scanner 103 emits light according to an image signal to the photosensitive drums 101Y, 101M, 101C, and 101K charged to a uniform potential. As a result, electrostatic latent images are formed on the photosensitive drums 101Y, 101M, 101C, and 101K.

Next, the electrostatic latent images are developed with toner stored in developing cartridges 104Y, 104M, 104C, and 104K, thereby forming toner images (visible images) on the photosensitive drums 101Y, 101M, 101C, and 101K, respectively. Next, the toner images formed on the photosensitive drums 101Y, 101M, 101C, and 101K are primarily transferred onto the intermediate transfer belt 102. Then, the toner image on the intermediate transfer belt 102 is conveyed to a secondary transfer portion by the intermediate transfer belt 102.

In parallel with such a toner image forming operation, sheets S are fed one by one from the sheet feeding device 30. Each of the sheets S is conveyed by registration rollers 110, which correct the skew of the sheet S, to the secondary transfer portion formed by a nip between the intermediate transfer belt 102 and the secondary transfer roller 105. At this time, the position of the sheet S in the sheet conveyance direction needs to be adjusted to the toner image formed on the intermediate transfer belt 102. Thus, the timing of the sheet S is adjusted by controlling the conveying speed of the registration rollers 110. Then, at the secondary transfer portion, a secondary transfer voltage is applied to the secondary transfer roller 105, thereby transferring the toner image from the intermediate transfer belt 102 onto the sheet S.

Then, the sheet S onto which the toner image is transferred is conveyed to a fixing unit 111. The sheet S is heated and pressurized by the fixing unit 111, thereby fixing the toner image to the sheet S. After the toner image is fixed, the sheet S is discharged to a discharge unit 113 at an upper portion of the apparatus by discharge rollers 112.

The printer 100 includes a door 115, which is an openable and closable opening/closing member. A separation unit 10 is exposed by opening the door 115, so that the separation unit 10 is detachable from the printer 100 in a direction X. In addition, the separation unit 10 is attachable thereto when the door 115 is open.

Figure 2A:
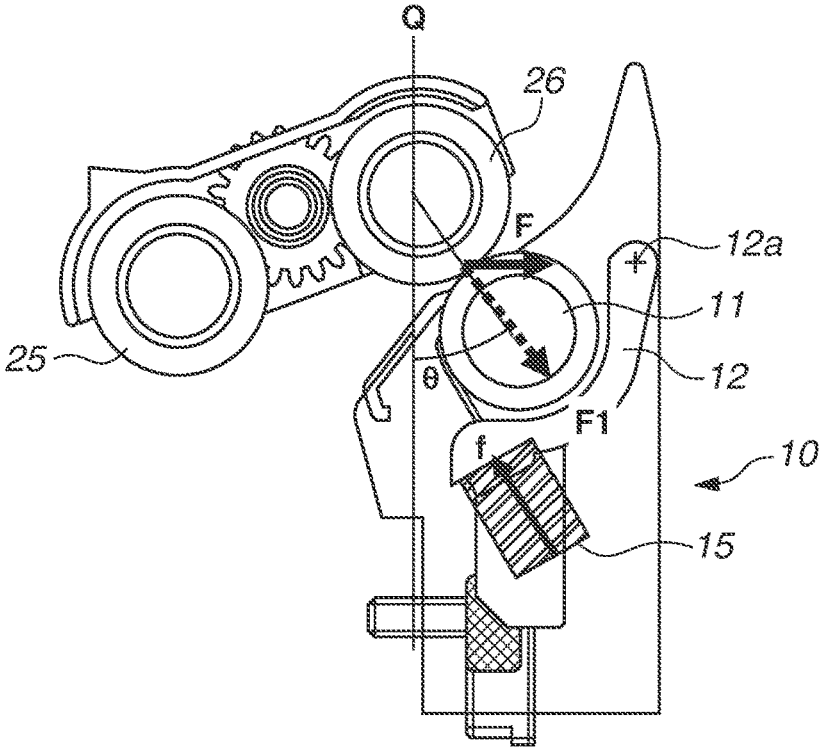
FIG. 2A is a cross-sectional view illustrating an abutting state of a separation rotating member and a feeding member in an attached state of a storage unit.
Figure 2B:
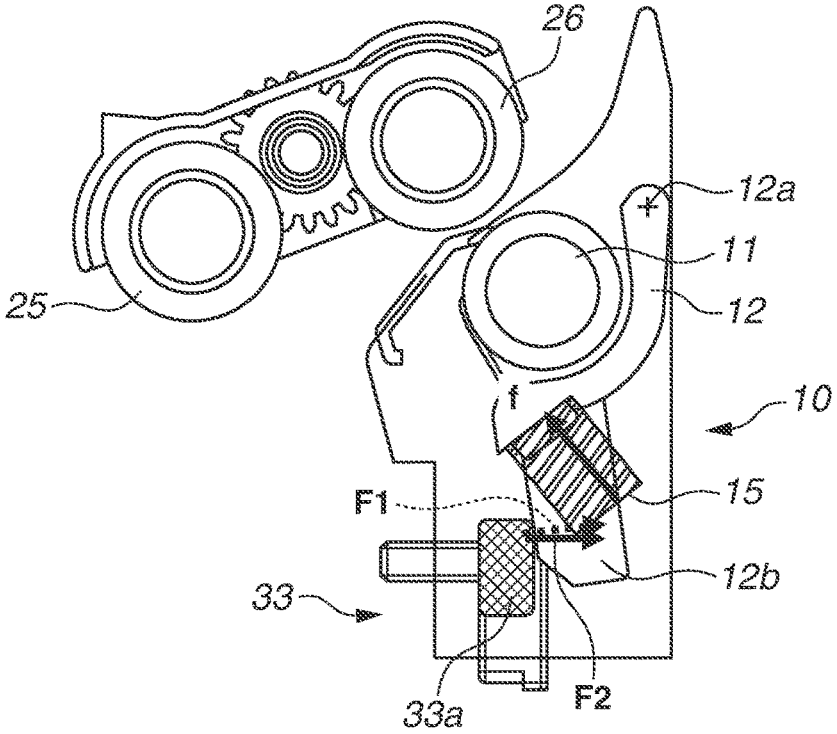
FIG. 2B is a cross-sectional view illustrating a separate state of the separation rotating member and the feeding member in a detached state of the storage unit.

Next, referring to FIGS. 1, 2A, 2B, and 3, the sheet feeding device 30 according to the present exemplary embodiment is described. FIG. 2A is a cross-sectional view illustrating an abutting state of a separation roller 11 and a feed roller 26 in the attached state of a feeding cassette 35. FIG. 2B is a cross-sectional view illustrating a separate state of the separation roller 11 and the feed roller 26 in the detached state of the feeding cassette 35.

The sheet feeding device 30 includes a feeding unit 20, a separation unit 10, a sheet feeding driving unit (not illustrated), and a feeding cassette 35 as a storage unit attachable to and detachable from the sheet feeding device 30. The feeding cassette 35 includes a cassette tray 36 as a storage portion, and a stacking plate 37 as a stacking member in which sheets S are stacked. The stacking plate 37 is swingably provided in the cassette tray 36.

In the present exemplary embodiment, the feeding unit 20 is provided in the printer 100. A feeding roller unit 21 is attachable to and detachable from the feeding unit 20 and rotatably holds a pickup roller 25 and the feed roller 26.

In the state where the feeding roller unit 21 is attached to the feeding unit 20, the feeding roller unit 21 is held by the feeding unit 20 so that the feeding roller unit 21 is pivotable about the rotating shaft of the feed roller 26. Further, the feeding roller unit 21 is biased in a direction P by a feeding spring 28 via a feeding pressure arm 27 so that the pickup roller 25 is brought into pressure contact with the sheets S on the stacking plate 37 with a predetermined biasing force.

The separation unit 10 is provided at a position opposed to the feeding unit 20. The separation unit 10 includes a separation roller 11 as a separation rotating member, a separation roller holder 12 as a first holding member, and a separation base 13 as a second holding member. Further, the separation unit 10 includes a separation spring 15 as a biasing member, and a separation cover 14 as a cover member that covers the separation roller 11, the separation roller holder 12, and the separation base 13. A small torque limiter is built in the separation roller 11 and brakes the separation roller 11 in its rotational direction with a predetermined torque. The separation roller holder 12 rotatably holds the separation roller 11 and is held to be swingable about a swinging center 12*a* with respect to the separation base 13. In other words, the separation base 13 is a holding member that holds the separation roller holder 12.

The separation spring 15 is fixed to the separation base 13 and presses the separation roller holder 12. The separation unit 10 is attached to the sheet feeding device 30 so that the separation roller 11 is located at a position opposed to the feed roller 26. The separation roller 11 is pressed against the feed roller 26 by the biasing force of the separation spring 15. The separation unit 10 is held to be attachable to and detachable from the sheet feeding device 30 in the direction X. This holding configuration and the operations of detaching and attaching the separation unit 10 will be described in detail below. In a case where the sheet feeding device 30 forms a part of the printer (image forming apparatus) 100, the separation unit 10 is attachable to and detachable from the printer (image forming apparatus) 100.

Next, the feeding operation of the sheet feeding device 30 is described. If the feeding cassette 35 is inserted into the sheet feeding device 30, the stacking plate 37 rises, and the top sheet S and the pickup roller 25 abut each other. At this time, as described above, the pickup roller 25 receives the biasing force of the feeding spring 28 via the feeding pressure arm 27 and abuts the sheet S with a predetermined pressure. Then, the pickup roller 25 and the feed roller 26 receive drive force from a driving unit (not illustrated) and rotate counterclockwise in FIG. 3.

Figure 3:
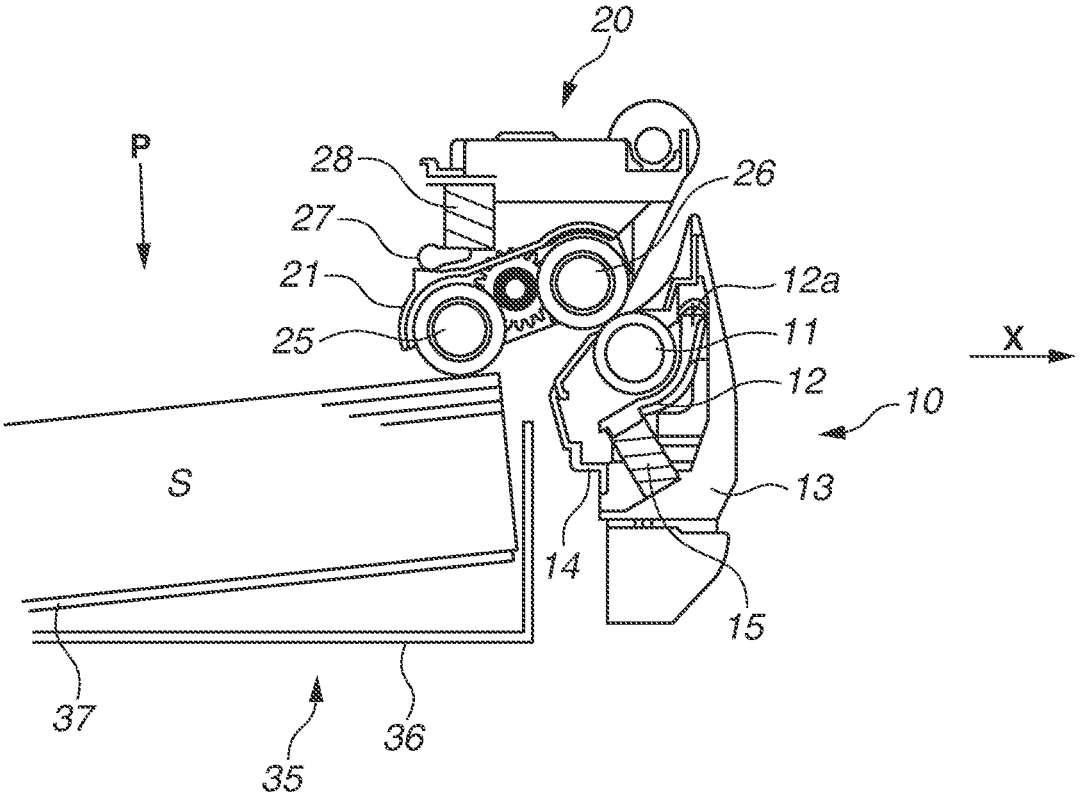
FIG. 3 is a schematic cross-sectional view illustrating a configuration of the sheet feeding device.

If the pickup roller 25 starts rotating, the sheet S starts moving in the right direction in FIG. 3 due to the friction between the pickup roller 25 and the sheet S. Then, the sheet S reaches a separation nip formed by the feed roller 26 and the separation roller 11. The separation nip has the function of, when two or more sheets S are sent to the separation nip by the pickup roller 25, separating the sheets S and sending only one of the sheet S downstream.

As described above, the torque limiter is built in the separation roller 11, and a torque as a resistance force is imparted in a direction opposite to the conveyance direction of the sheet S. This torque is set in such a manner that the separation roller 11 rotates, when only one sheet S is present in the separation nip, driven by the feed roller 26, and the separation roller 11 stops when two sheets S enter the separation nip. In this way, at the separation nip, the sheets S can be conveyed one by one downstream. Then, each of the sheets S is conveyed to the registration rollers 110 by the rotation of the pickup roller 25 and the feed roller 26.

Figure 4A:
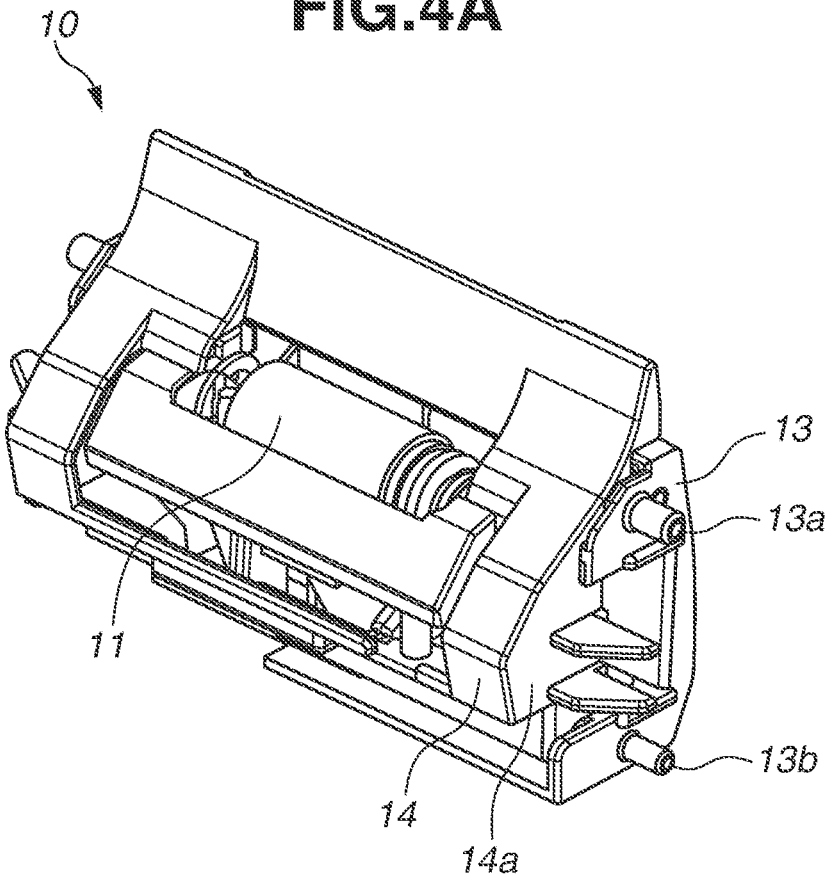
FIG. 4A is a schematic perspective view of a separation unit viewed from a separation rotating member side.
Figure 4B:
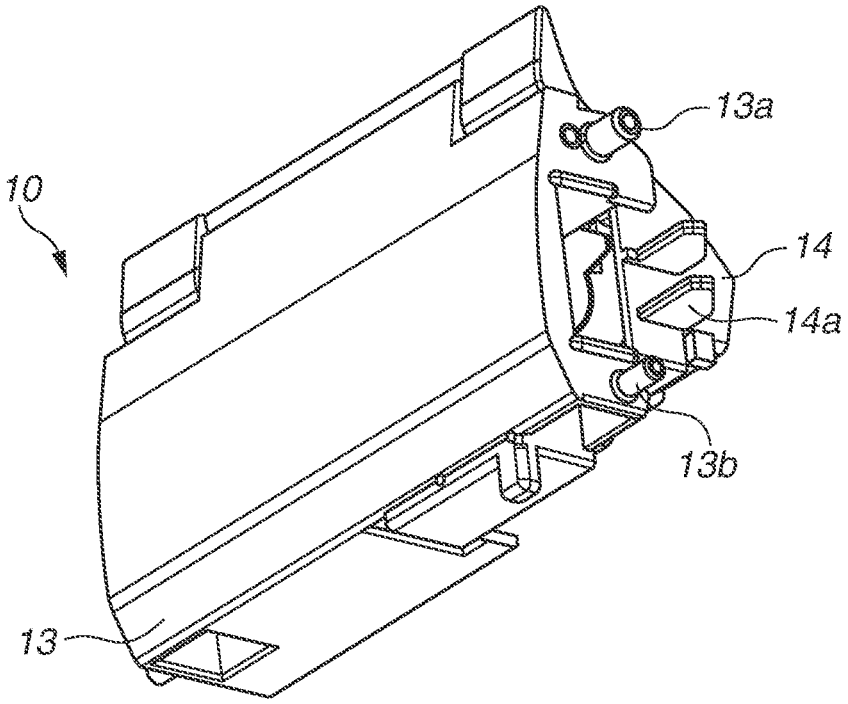
FIG. 4B is a schematic perspective view of the separation unit viewed from a second holding member side.

The configuration of the separation unit 10 and a method for holding the separation unit 10 are described in detail with reference to FIGS. 4A to 6. FIG. 4A is a schematic perspective view of the separation unit 10 viewed from the separation roller 11 side. FIG. 4B is a schematic perspective view of the separation unit 10 viewed from the separation base 13 side.

Figure 5A:
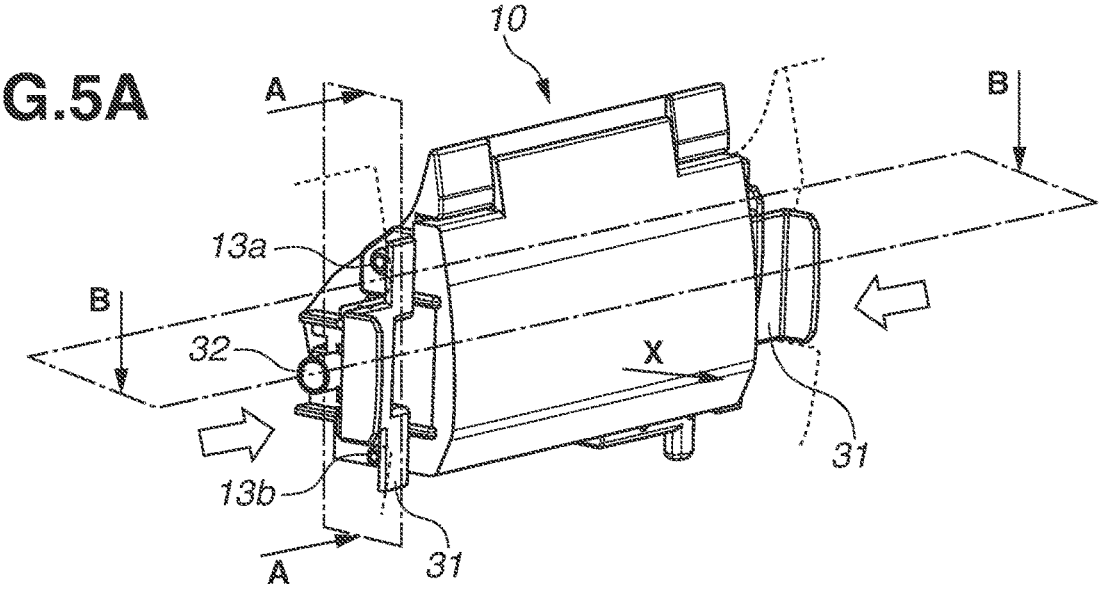
FIG. 5A illustrates an attached state of the separation unit.
Figure 5B:
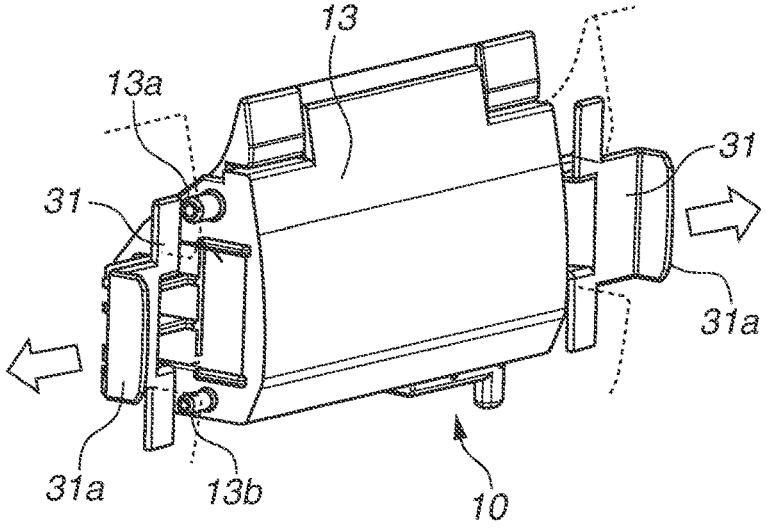
FIG. 5B illustrates a state where an engagement member is moved to a second position (retracted position).
Figure 5C:
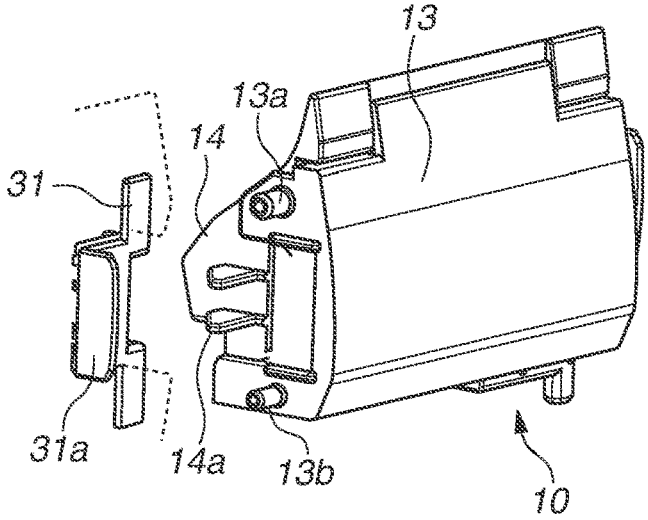
FIG. 5C illustrates a state where the separation unit is detached from the sheet feeding device.
Figure 6:
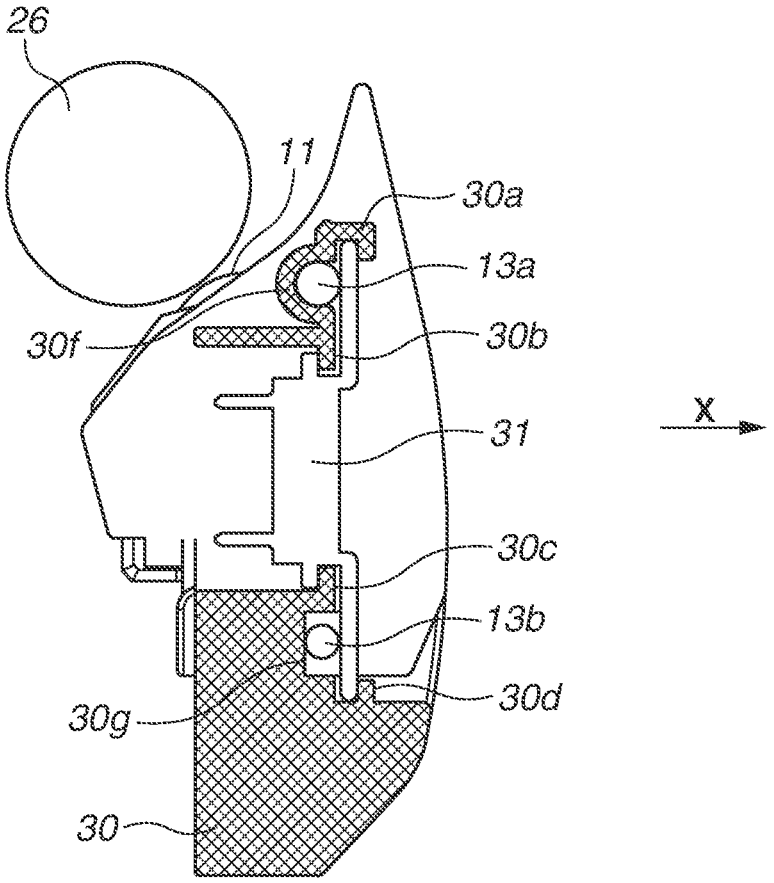
FIG. 6 is a schematic cross-sectional view illustrating an engaged state of the engagement member and a first positioning portion.

FIGS. 5A, 5B, and 5C are schematic diagrams illustrating a motion of separation shutters 31 as an engagement member, and the operations of attaching and detaching the separation unit 10. FIG. 5A illustrates an attached state of the separation unit 10. FIG. 5B illustrates a state where the separation shutters 31 are moved to a second position (retracted position). FIG. 5C illustrates a state where the separation unit 10 is detached from the sheet feeding device 30. FIG. 6 is a schematic cross-sectional view illustrating an engaged state of each separation shutter 31 and protrusion portions 13*a* and 13*b* and is an A-A cross-sectional view in FIG. 5A.

As described above, the separation unit 10 includes the separation roller 11, the separation roller holder 12, the separation base 13, the separation spring 15, and the separation cover 14. As illustrated in FIGS. 4A and 4B, the separation unit 10 is unitized in such a manner that the inside of the separation unit 10 is covered by the separation base 13 and the separation cover 14. The separation unit 10 is unitized in such a form, whereby an operator such as a user or a serviceperson is less likely to touch internal components. This facilitates handling of the separation unit 10.

On each side of the separation base 13, a pair of protrusion portions 13*a* and 13*b* as a first positioning portion for positioning the separation unit 10 relative to the sheet feeding device 30 is provided. In the separation cover 14, cam portions 14*a* as an engaged portion that abuts separation shutters 31 provided in the sheet feeding device 30 and moves the separation shutters 31 when the separation unit 10 is attached are provided. In other words, the separation cover 14 is an engaged member (slide member) including the cam portions 14*a* as the engaged portion, and the separation cover 14 also functions as a cover member that covers the separation roller holder 12.

As illustrated in FIGS. 5A, 5B, 5C, and 6, the separation shutters 31 (engagement member) are disposed in the sheet feeding device 30. As illustrated in FIG. 6, each separation shutter 31 is engaged with rail portions 30*a* to 30*d* of the sheet feeding device 30. While the movement of the separation shutter 31 in the left-right direction in FIG. 6 is restricted, the separation shutter 31 is held so as to be slidable with respect to the sheet feeding device 30. The slide direction is a direction intersecting the detachment direction of the separation unit 10. Further, the separation shutters 31 are biased in the directions of arrows in FIG. 5A by shutter springs 32. The positions of the separation shutters 31 in FIG. 5A are defined as a first position. When the separation unit 10 is attached to the sheet feeding device 30 and the separation shutters 31 are at the first position, as illustrated in FIG. 6, in the separation unit 10, the protrusion portions 13*a* and 13*b* of the separation base 13 are fitted in recessed portions 30*f* and 30*g*, respectively, which are second positioning portions on the sheet feeding device 30 side. Each separation shutter 31 is engaged with the protrusion portions 13*a* and 13*b* of the separation base 13 to restrict the movement of the separation unit 10 in the direction X. This is the attached state of the separation unit 10 to the sheet feeding device 30.

The separation shutters 31 are movable in the directions of arrows in FIG. 5B from the first position. The operator such as the user or the serviceperson can move the separation shutters 31 in the directions of the arrows in FIG. 5B by holding gripping portions 31*a*. If the operator moves the separation shutters 31 in the directions of the arrows in FIG. 5B, the engagement between the separation shutters 31 and the protrusion portions 13*a* and 13*b* of the separation base 13 is released in time, and the separation unit 10 becomes movable in the direction X. The positions of the separation shutters 31 at this time are defined as a second position.

In the present exemplary embodiment, a configuration is employed in which if the feeding cassette 35 is pulled out of the sheet feeding device 30, the separation nip is released, and the separation roller 11 and the feed roller 26 are separated from each other. This is to prevent a sheet S from remaining in the separation nip when the feeding cassette 35 is pulled out of the sheet feeding device 30. In other words, in this configuration, a separation nip release mechanism enables the separation roller 11 to abut and separate from the feed roller 26.

The separation nip release mechanism is described with reference to FIGS. 2A, 2B, 7A, and 7B. FIGS. 2A and 2B are schematic cross-sectional views illustrating a relationship between forces acting on the separation unit 10. FIG. 2A is a cross-sectional view illustrating the abutting state of the separation roller 11 and the feed roller 26 in the attached state of the feeding cassette 35. FIG. 2B is a cross-sectional view illustrating the separate state of the separation roller 11 and the feed roller 26 in the detached state of the feeding cassette 35.

FIGS. 2A and 2B illustrate the operation of a separation nip release lever 33 and the action of the separation nip release lever 33 on the separation roller holder 12. FIG. 2A illustrates the attached state of the feeding cassette 35 during the suspension of the sheet feeding device 30. FIG. 2B illustrates the detached state of the feeding cassette 35 during the suspension of the sheet feeding device 30.

Figure 7A:
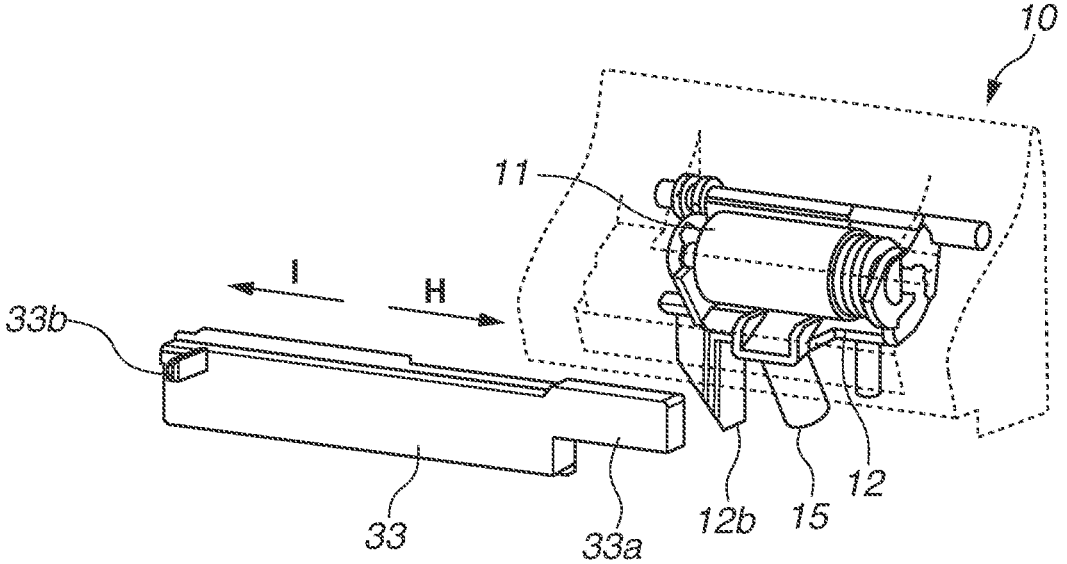
FIG. 7A is a diagram illustrating an operation of a separation nip release lever and an action of the separation nip release lever on a first holding member in the attached state of the storage unit.
Figure 7B:
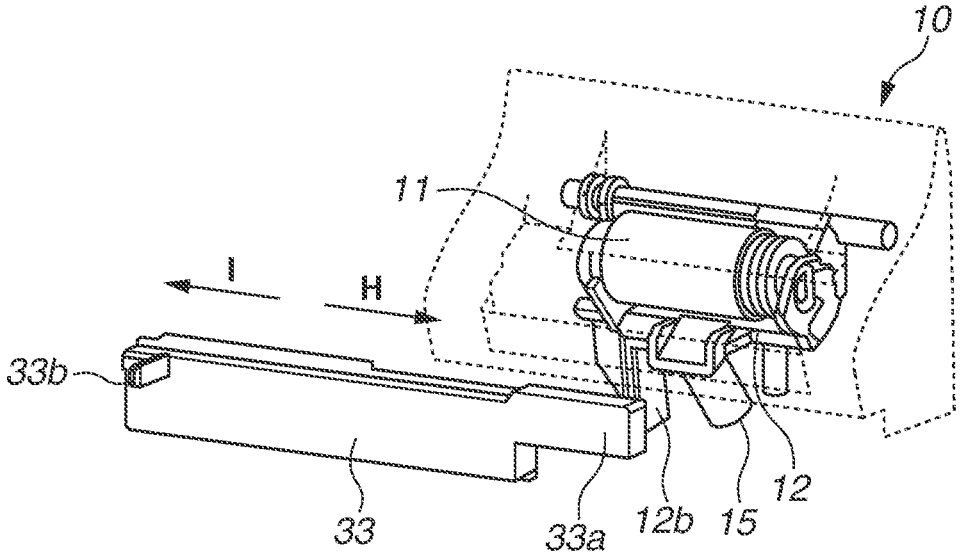
FIG. 7B is a diagram illustrating the operation of the separation nip release lever and the action of the separation nip release lever on the first holding member in the detached state of the storage unit.

FIG. 7A is a diagram illustrating the operation of the separation nip release lever 33 and the action of the separation nip release lever 33 on the separation roller holder 12 in the attached state of the feeding cassette 35. FIG. 7B is a diagram illustrating the operation of the separation nip release lever 33 and the action of the separation nip release lever 33 on the separation roller holder 12 in the detached state of the feeding cassette 35.

The separation nip release lever 33 is biased in a direction H by a biasing member (not illustrated). If the feeding cassette 35 is inserted, the feeding cassette 35 abuts a cassette abutment portion 33*b* of the separation nip release lever 33 and moves the separation nip release lever 33 in a direction I against the biasing force of the biasing member. If the attachment of the feeding cassette 35 to the sheet feeding device 30 is completed, this results in the state of FIGS. 2A and 7A, and the separation nip release lever 33 does not act on the separation roller holder 12. If the feeding cassette 35 is detached, the separation nip release lever 33 moves in the direction H in FIGS. 7A and 7B by the action of the biasing member. If the separation nip release lever 33 moves in the direction H, then as illustrated in FIG. 7B, an abutment portion 33*a* of the separation nip release lever 33 abuts a separation cam portion 12*b* of the separation roller holder 12. As a result, as illustrated in FIG. 2B, the separation roller holder 12 rotates about the swinging center 12*a*, and the separation roller 11 separates from the feed roller 26. The separation nip release lever 33 changes the separate state and the abutting state of the separation roller 11 and the feed roller 26.

The operation of detaching the separation unit 10 is described in detail with reference to FIGS. 1 to 6. As illustrated in FIGS. 3, 5A, 5B, and 5C, the separation unit 10 is detachable in the downstream direction of the conveyance direction of a sheet S (in the direction X). Hereinafter, the direction X is the detachment direction.

Normally, the separation unit 10 is in the attached state as illustrated in FIG. 5A. When detaching the separation unit 10, first, the operator such as the user or the serviceperson opens the door 115 illustrated in FIG. 1 and exposes the separation unit 10 as illustrated in FIG. 5A. Then, the operator grips the gripping portions 31*a* of the separation shutters 31, moves the separation shutters 31 in the directions of the arrows in FIG. 5B, and moves the separation shutters 31 to the second position. If the separation shutters 31 reach the second position and the engagement between the separation shutters 31 and the protrusion portions 13*a* and 13*b* of the separation base 13 is released, then as illustrated in FIG. 5C, the separation unit 10 protrudes in the direction X by a pop-up force F generated by a force f of the separation spring 15. The operator is only required to retrieve the protruding separation unit 10, to complete the detachment of the separation unit 10. At this time, since the separation unit 10 is detached from the downstream side in the conveyance direction of the sheet S, the feeding roller unit 21 does not need to be detached.

Next, a description is given of the pop-up force F that is the force causing the separation unit 10 to protrude. The pop-up force F can be restated as a force in the direction X received by the separation unit 10 in the attached state. As described above, in the attached state, the movement of the separation unit 10 in the direction X is restricted by the separation shutters 31. In other words, the force F in the direction X received by the separation unit 10 is received by the separation shutters 31 also during the feeding operation. The positional accuracy of the separation unit 10 influences the separation performance of the sheet feeding device 30. Therefore, it is necessary to reduce the deformation of the separation shutters 31 due to a force received from the separation unit 10 and to reduce a change in the position of the separation unit 10. In the present exemplary embodiment, as illustrated in FIG. 6, the rail portions 30*a* to 30*d* that support each separation shutter 31 are placed near the protrusion portions 13*a* and 13*b* of the separation base 13. The separation shutters 31 are supported near the places where forces are received from the separation unit 10 in this way, thereby preventing the bending of the separation shutters 31 and reducing a change in the position of the separation unit 10.

Meanwhile, the force F in the direction X received by the separation unit 10 is used as the force causing the separation unit 10 to protrude in the direction X (pop-up force). The transmission path of the pop-up force F differs between the attached state of the feeding cassette 35 and the detached state of the feeding cassette 35.

First, a case where the feeding cassette 35 is attached is described. In the attached state of the feeding cassette 35, as illustrated in FIG. 2A, the separation unit 10 is in the state where the separation roller 11 and the feed roller 26 abut each other. At this time, as described above, the separation roller 11 receives the biasing force f of the separation spring 15 via the separation roller holder 12 and abuts the feed roller 26 with a force F1. As a result, the separation roller 11 receives the same force F1 as a reaction force. The force F1 is transmitted to the separation base 13 via the separation roller holder 12. A direction-X component force of the force F1 is the pop-up force F. In this way, the pop-up force F is obtained using the biasing force f of the separation spring 15.

The magnitude of the pop-up force F varies depending on the direction of the separation nip. In the present exemplary embodiment, as illustrated in FIG. 2A, the separation roller 11 abuts the right side of the feed roller 26 with respect to a vertical line Q passing through the center of the feed roller 26. The separation roller 11 is thus caused to abut the downstream side in the rotational direction of the feed roller 26 with respect to the center of the feed roller 26, whereby the separation unit 10 can obtain the direction-X component force of the force F1, i.e., the pop-up force F, in the downstream direction of the conveyance direction of the sheet S by the action of the separation spring 15. If an angle θ between a perpendicular line to the separation nip and the vertical line Q illustrated in FIG. 2A is between 0° and 90°, the greater the angle θ is, the greater the pop-up force F to be obtained is.

Next, a case where the feeding cassette 35 is detached is described. In the detached state of the feeding cassette 35, as illustrated in FIG. 2B, the separation unit 10 is in the state where the separation roller 11 and the feed roller 26 are separate from each other, and the separation roller holder 12 and the separation nip release lever 33 abut each other. At this time also, the separation roller holder 12 receives the biasing force f of the separation spring 15. However, since the separation roller 11 and the feed roller 26 are separate from each other, the biasing force f is not transmitted to the feed roller 26. The biasing force f of the separation spring 15 is transmitted as a force F2 to the separation nip release lever 33 on the sheet feeding device 30 side, and the separation roller holder 12 receives the reaction force to the force F2 and transmits the reaction force to the separation base 13. A direction-X component force of the force F2 is the pop-up force F. At this time, the pop-up force F is also obtained using the biasing force f of the separation spring 15.

Next, the operation of attaching the separation unit 10 is described with reference to FIGS. 5A, 5B, and 5C. The separation unit 10 is attached in the reverse order of the detachment operation. More specifically, the separation unit 10 is moved in a direction opposite to the direction X from the state of FIG. 5C and inserted to the position in FIG. 5B. When the separation unit is not attached, the separation shutters 31 are located at the first position by the action of the shutter springs 32. In the separation cover 14 of the separation unit 10, the cam portions 14*a* are provided that have surfaces inclined with respect to the insertion/removal direction of the separation unit 10. The cam portions 14*a* push the separation shutters 31 to open in the directions of the arrows in FIG. 5B in the process of attaching the separation unit 10, and move the separation shutters 31 in a sliding manner to positions (second position) through which the protrusion portions 13*a* and 13*b* pass. If the protrusion portions 13*a* and 13*b* of the separation unit 10 is fitted in the recessed portions 30*f* and 30*g* of the sheet feeding device 30, the cam portions 14*a* of the separation unit 10 are released from the separation shutters 31, and the separation shutters 31 move to the first position in FIG. 5A. In this way, when attaching the separation unit 10, the operator does not need to move the separation shutters 31, and can attach the separation unit 10 only by gripping and inserting the separation unit 10.

As described above, according to the present exemplary embodiment, the separation shutters 31 are moved, whereby the engaged state of the separation unit 10 is released. Simultaneously, the separation unit 10 receives the reaction force F to the biasing force f of the separation spring 15, thereby protruding in the detachment direction. As a result, when the operator replaces the separation unit 10, it is easy for the operator to recognize the separation unit 10 as a detachment target. The separation unit 10 is merely positioned relative to the sheet feeding device 30 by the separation shutters 31. Thus, the separation shutters 31 are moved to the second position, whereby the positioning of the separation unit 10 relative to the sheet feeding device 30 is released. In this way, the operator can detach the separation unit 10 only by moving the separation shutters 31.

By using the force of the separation spring 15 that biases the separation roller 11, it is possible to increase the visibility of the separation unit 10 as a replacement target at a low cost and also to detach the separation unit 10 in one step, which is to move the separation shutters 31.

In the present exemplary embodiment, the separation shutters 31 as the engagement member are provided on both sides of the separation unit 10. Alternatively, a separation shutter 31 may be provided on only one side of the separation unit 10 so long as the usability is acceptable. In addition, in this case, when the separation shutter 31 moves to the second position, the restriction of the movement of one side of the separation unit 10 in the direction X is released, and the separation unit 10 receives the pop-up force F. In this way, it is possible to obtain similar effects.

In the present exemplary embodiment, a configuration is employed in which the separation roller 11 separates from the feed roller 26 when the feeding cassette 35 is detached from the sheet feeding device 30. However, the present exemplary embodiment is not limited to this, and may be applied to a case where the separation nip is not released, or a configuration in which the separation nip is temporarily released in the process of inserting or removing the feeding cassette 35. At this time, a member that abuts the separation cam portion 12*b* of the separation roller holder 12 may be provided in the feeding cassette 35. The present exemplary embodiment is applicable to any configuration in which the separation unit 10 is biased in the insertion/removal direction X using the reaction force to the force f of the separation spring 15.

In the first exemplary embodiment, the pop-up force F is generated by the biasing force f of the separation spring 15, thereby causing the separation unit 10 to protrude. On the other hand, a second exemplary embodiment is characterized in that the function of generating pop-up forces F3 in addition to the pop-up force F is added to separation shutters 131, thereby increasing the protrusion force of a separation unit 140 when the separation shutters 131 reach the second position. In the present exemplary embodiment, components similar to those of the first exemplary embodiment are designated by the same signs, and are not described.

Figure 8A:
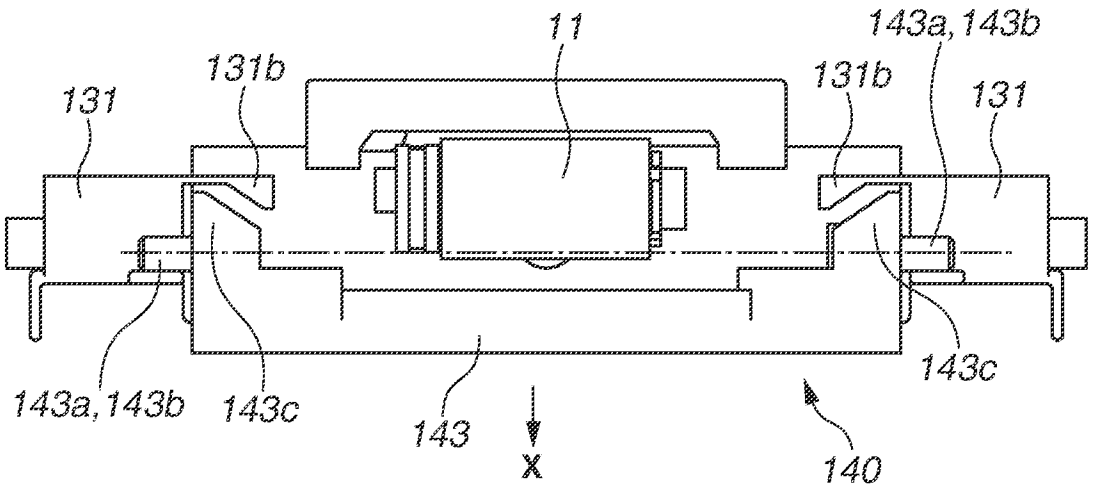
FIG. 8A is a diagram illustrating an attached state of a separation unit according to a second exemplary embodiment.
Figure 8B:
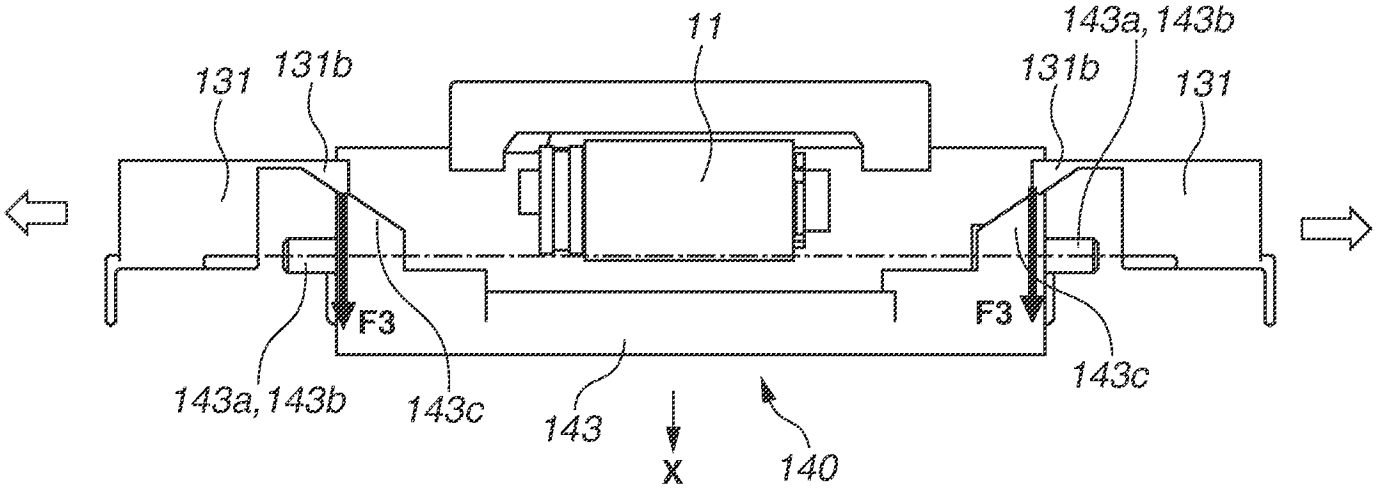
FIG. 8B is a diagram illustrating a state where an engagement member according to the second exemplary embodiment reaches a second position.

FIGS. 8A and 8B are schematic cross-sectional views illustrating an action of leaf spring portions 131*b* (second biasing member) on a separation unit 140 when separation shutters 131 as an engagement member according to the second exemplary embodiment move, and correspond to a B-B cross section in FIG. 5A in the first exemplary embodiment. FIG. 8A illustrates the attached state of the separation unit 140. FIG. 8B illustrates a state where the separation shutters 131 reach the second position.

In the present exemplary embodiment, in separation shutters 131, leaf spring portions 131*b* are provided for assisting the pop-up force F when a separation unit 140 is detached. In a separation base 143 of the separation unit 140, abutment portions 143*c* are provided that abut the leaf spring portions 131*b* when the separation shutters 131 are at the second position. Also in the present exemplary embodiment, when the separation unit 140 is attached, the movement of the separation unit 140 in the direction X is restricted by positioning portions 143*a* and 143*b* by engaging with the separation shutters 131.

When the separation unit 140 is in the attached state as illustrated in FIG. 8A, the leaf spring portions 131*b* of the separation shutters 131 are separate from the separation unit 140, and do not act on the separation unit 140. If the operator moves the separation shutters 131 in the directions of arrows in FIG. 8B to detach the separation unit 140, the leaf spring portions 131*b* of the separation shutters 131 bend in the up direction in FIGS. 8A and 8B along with the movement of the separation shutters 131. As a result, the separation shutters 131 reach the second position and continue to bend until the restriction of the movement of the separation unit 140 in the direction X is released. When the separation shutters 131 reach the second position as illustrated in FIG. 8B, the leaf spring portions 131*b* impart forces F3 to the abutment portions 143*c*. If the restriction of the movement of the separation unit 140 in the direction X is released, the bending is released. The release of the bending imparts the additional pop-up forces F3 to the separation unit 140 via the abutment portions 143*c*.

With such a configuration, even in a case where the pop-up force F of the separation spring 15 is small, it is possible, by imparting the additional pop-up forces F3, to control the protrusion force of the separation unit 140 when the separation unit 140 is detached. This can improve the usability.

In the present exemplary embodiment, leaf spring shapes are provided in the separation shutters 131, to impart the additional pop-up forces F3. Alternatively, a second biasing member may be provided in the separation shutters 131.

In the first and second exemplary embodiments, the separation units 10 and 140 are positioned using the sliding separation shutters 31 and 131. In a third exemplary embodiment, a description is given of a configuration in which pivoting shutters 231 are used, and the shutter springs 32 are not used.

Figure 9:
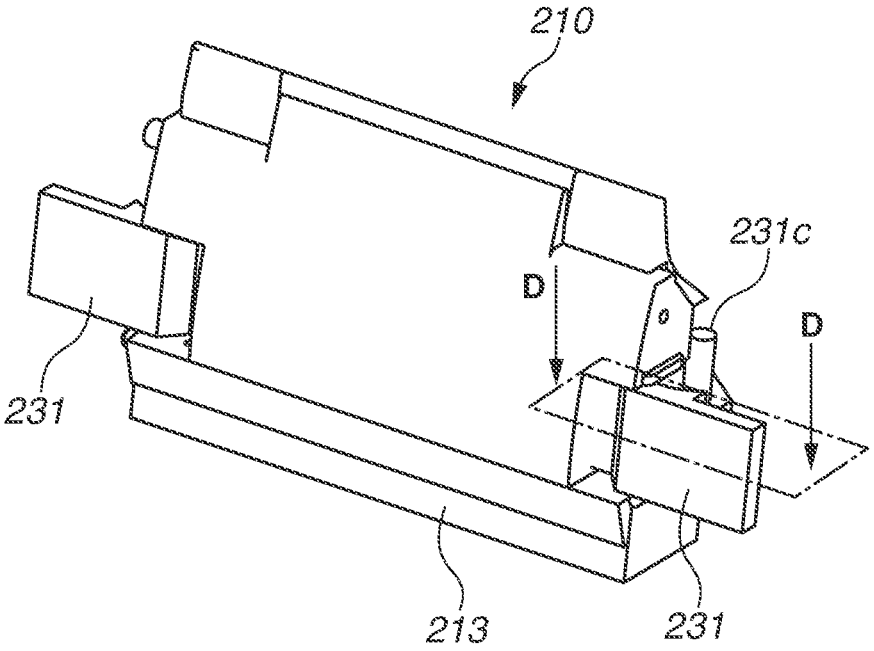
FIG. 9 is a schematic perspective view illustrating a configuration of a separation unit according to a third exemplary embodiment.
Figure 10A:
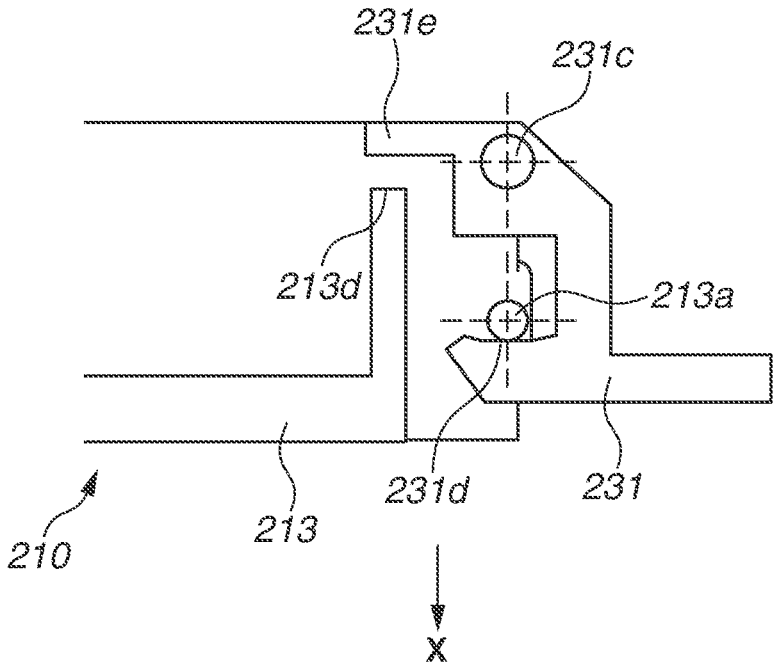
FIGS. 10A and 10B are schematic cross-sectional views illustrating the separation unit and an engagement member according to the third exemplary embodiment.
Figure 10B:
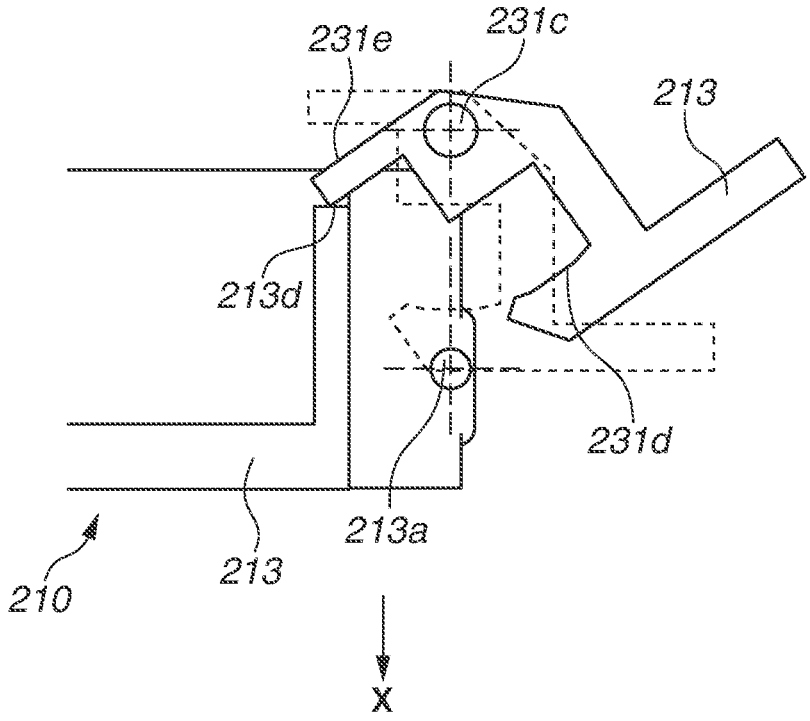

FIG. 9 is a schematic perspective view illustrating configurations of a separation unit 210 and separation shutters 231 according to the present exemplary embodiment. FIGS. 10A and 10B are schematic cross-sectional views illustrating operations of the separation unit 210 and each separation shutter 231 according to the third exemplary embodiment and correspond to a D-D cross section in FIG. 9. FIG. 10A illustrates an attached state of the separation unit 210. FIG. 10B illustrates a state where the separation shutter 231 is pivoted.

In the present exemplary embodiment, unlike the first and second exemplary embodiments, a separation unit 210 includes positioning shafts 213*a* extending in the up-down direction of a separation base 213, and the movement of the separation unit 210 in the direction X is restricted by the positioning shafts 213*a* by engaging with separation shutters 231. Each separation shutter 231 is pivotably held relative to the sheet feeding device 30 about a pivotal shaft 231*c* that is parallel to the positioning shaft 213*a* of the separation unit 210. In the separation shutter 231, a locking portion 231*d* that is engaged with the positioning shaft 213*a* of the separation base 213 and restricts the movement of the separation unit 210 in the direction X is provided. As illustrated in FIG. 10A, the locking portion 231*d* has a shape concentric with the pivotal shaft 231*c*, and the pivotal shaft 231*c* is placed at the same position as the positioning shaft 213*a* of the separation unit 210 in the left-right direction in FIGS. 10A and 10B. With such a configuration, even if the separation unit 210 receives a force in the direction X, the separation shutter 231 opens, and the separation unit 210 does not move. In the separation shutter 231, a push-out portion 231*e* that pushes out the separation base 213 in the direction X when the separation shutter 231 pivots, is provided. On the other hand, in the separation base 213, an abutment portion 213*d* that abuts the push-out portion 231*e* of the separation shutter 231 is provided.

When the separation unit 210 is in the attached state, the separation unit 210 and the separation shutter 231 are in the state of FIG. 10A. The movement of the separation unit 210 in the direction X is restricted by the positioning shaft 213*a* by engaging with the locking portion 231*d* of the separation shutter 231. When replacing the separation unit 210, the operator pivots the separation shutter 231 counterclockwise in FIGS. 10A and 10B. As a result, the locking portion 231*d* of the separation shutter 231 comes off the positioning shaft 213*a* of the separation unit 210. At that time, similar to the first and second exemplary embodiments, the separation unit 210 receives the pop-up force F. The separation shutter 231 reaches the second position, and the restriction of the movement of the separation unit 210 in the direction X is released. Simultaneously, the push-out portion 231*e* of the separation shutter 231 abuts the abutment portion 213*d* of the separation base 213. Further, if the separation shutter 231 is pivoted, the push-out portion 231*e* of the separation shutter 231 presses the abutment portion 213*d* of the separation base 213, thereby moving the separation unit 210 in the direction X as illustrated in FIG. 10B.

When the separation unit 210 is attached, in the separation unit 210, the abutment portion 213*d* of the separation base 213 and the push-out portion 231*e* of the separation shutter 231 abut each other when the separation shutter 231 is at the second position. The separation unit 210 is further pushed in in the attachment direction (direction opposite to the direction X) from this state, whereby the separation shutter 231 returns to the first position. Simultaneously, the separation unit 210 is pushed back by the pop-up force F to the position where the positioning shaft 213*a* abuts the locking portion 231*d* of the separation shutter 231. Then, the attachment of the separation unit 210 is completed as illustrated in FIG. 10A.

With such a configuration, even after the separation unit 210 protrudes by the pop-up force F, it is possible to cause the separation unit 210 to further protrude. Thus, it is possible to adjust the amount of protrusion and to obtain desired visibility.

According to the present disclosure, it is possible to provide a sheet feeding device and an image forming apparatus in which usability for detaching a separation unit is improved.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. A sheet feeding device comprising:

a storage unit including a stacking member and configured to store sheets stacked in the stacking member;

a feeding unit configured to feed the sheets stacked in the stacking member;

an opening/closing member configured to open and close with respect to the sheet feeding device;

a grip portion grippable by a user and configured to be movable; and a separation unit configured to separate the sheets fed by the feeding unit one by one, wherein the separation unit is exposed by opening of the opening/closing member, and the exposed separation unit is detachable from the sheet feeding device in a detachment direction, wherein the separation unit includes a separation rotating member configured to rotate and to abut and separate from the feeding unit, a first biasing member configured to bias the separation rotating member toward the feeding unit, and an engaged member configured to be engaged with the grip portion included in the sheet feeding device, wherein the grip portion includes a second biasing member, wherein the grip portion is configured to move to a first position where the grip portion is engaged with the engaged member, and a second position away from the engaged member, wherein, in a state where the grip portion is located at the second position, the separation unit is detached together with the engaged member from the sheet feeding device and is separated from the grip portion, and wherein the separation unit moves in the detachment direction using the first biasing member and the second biasing member in a case where the grip portion moves from the first position to the second position in a state where the separation unit is attached to the sheet feeding device.

2. The sheet feeding device according to claim 1, wherein the separation unit further includes a first holding member configured to rotatably hold the separation rotating member, and a second holding member configured to swingably hold the first holding member, and wherein the first biasing member is configured to be held by the second holding member.

3. The sheet feeding device according to claim 2, wherein the first biasing member is configured to cause the separation rotating member to abut the feeding unit by biasing the first holding member.

4. The sheet feeding device according to claim 3, wherein the engaged member doubles as a cover member configured to cover a part of the first holding member.

5. The sheet feeding device according to claim 4, wherein the second holding member includes a first positioning portion, wherein the sheet feeding device includes a second positioning portion configured to position the first positioning portion, and wherein the first positioning portion is positioned by the second positioning portion in the state where the separation unit is attached to the sheet feeding device.

6. The sheet feeding device according to claim 1, wherein the grip portion is a slide member configured to move in a sliding manner in a direction intersecting the detachment direction.

7. The sheet feeding device according to claim 1, wherein the storage unit is configured in such a manner that a storage portion, in which plural sheets are stacked, is attachable to and detachable from the sheet feeding device, wherein the separation unit and the feeding unit abut each other in a state where the storage portion is attached to the sheet feeding device, and wherein the separation unit and the feeding unit are separate from each other in a state where the storage portion is detached from the sheet feeding device.

8. The sheet feeding device according to claim 1, wherein, in the case where the grip portion moves from the first position to the second position in the state where the separation unit is attached to the sheet feeding device, the separation unit moves in the detachment direction using the first biasing member either in a state where the separation unit abuts the feeding unit or a state where the separation unit is separate from the feeding unit.

* * * * *